US011649013B2

(12) United States Patent
Wurts

(10) Patent No.: US 11,649,013 B2
(45) Date of Patent: May 16, 2023

(54) THREE PIECE BLANK FOR FORMING A SURF CRAFT

(71) Applicant: William Aldis Wurts, Princeton, KY (US)

(72) Inventor: William Aldis Wurts, Princeton, KY (US)

( * ) Notice: Subject to any disclaimer, the term of this patent is extended or adjusted under 35 U.S.C. 154(b) by 0 days.

(21) Appl. No.: 17/811,935

(22) Filed: Jul. 12, 2022

(65) Prior Publication Data

US 2023/0028303 A1 Jan. 26, 2023

Related U.S. Application Data

(60) Provisional application No. 63/203,361, filed on Jul. 20, 2021.

(51) Int. Cl.
*B63B 32/50* (2020.01)
*B63B 32/59* (2020.01)
*B63B 32/57* (2020.01)

(52) U.S. Cl.
CPC ..... *B63B 32/50* (2020.02); *B63B 32/57* (2020.02); *B63B 32/59* (2020.02)

(58) Field of Classification Search
CPC ..... B63B 32/00; B63B 32/50; B63B 32/53; B63B 32/57; B63B 32/59
See application file for complete search history.

(56) References Cited

U.S. PATENT DOCUMENTS

| | | | | |
|---|---|---|---|---|
| 3,077,617 | A * | 2/1963 | Steffel | B63B 32/30 280/18 |
| 3,099,025 | A * | 7/1963 | Merkley | B63B 32/30 441/79 |
| 6,203,389 | B1 | 3/2001 | Pearson | |
| 7,074,098 | B1 | 7/2006 | Acosta, Jr. | |
| 9,021,973 | B2 * | 5/2015 | Smith | B63B 32/70 114/123 |
| 9,440,715 | B2 | 9/2016 | Rizzo | |
| 9,764,805 | B2 * | 9/2017 | Miles | B63B 32/50 |
| 10,472,025 | B2 * | 11/2019 | Thompson | B32B 5/32 |
| 10,974,797 | B1 | 4/2021 | Wurts | |

FOREIGN PATENT DOCUMENTS

| | | | | |
|---|---|---|---|---|
| DE | 3505605 | A1 * | 8/1986 | |
| EP | 0059345 | A1 * | 9/1982 | |
| WO | WO-2012062973 | A1 * | 5/2012 | B29C 70/82 |

* cited by examiner

*Primary Examiner* — Ajay Vasudeva
(74) *Attorney, Agent, or Firm* — Robinson IP Law, PLLC

(57) ABSTRACT

A method of forming a surf craft includes: providing a bottom section including a surface thereon, wherein at least a portion of the bottom surface section defines a bottom portion of a channel formed on a bottom surface of the surf craft; joining a first side section with the bottom section, the first side section having a shaped wall portion defining a first side wall of the channel formed on the bottom surface of the surf craft; joining a second side section with the bottom section, the second side section having a shaped wall portion defining a second side wall of the channel formed on the bottom surface of the surf craft, the second side wall being opposed to the first side wall; and shaping one or more outer edges of the bottom section, first side section, and second side section into a desired shape of the surf craft.

12 Claims, 19 Drawing Sheets

THREE PIECE BLANK FOR FORMING A SURF CRAFT

CROSS-REFERENCE TO RELATED APPLICATION

This application claims priority to and is a non-provisional of U.S. Patent Application Ser. No. 62/203,361 for a "Three Piece Blank for Forming a Surf Craft" filed on Jul. 20, 2021, the contents of which are incorporated herein by reference in its entirety.

FIELD

This disclosure relates to the field of surf craft. More particularly, this disclosure relates to a blank for forming a surf craft.

BACKGROUND

Surf craft, such as bodyboards, kneeboards, surfboards, sailboards, wake surf boards, wakeboards, paddleboards, and other similar boards may be formed having cores made of foam, wood, and other lightweight materials. Existing surf craft may be formed with two pieces of a lightweight core foam material that are joined together along a centerline of the surf craft. The core, prior to any shaping, may be referred to as a blank. The blank is subsequently shaped into a desired form for the surf craft, and various additional layers or skins may be added (such as fiberglass, plastics, and other suitable materials).

Surf craft are commonly formed from blanks using hand shaping tools. However, it is difficult to form complicated shapes on the surf craft. For example, forming a channel on a bottom of a surf craft such as the channel disclosed in U.S. Pat. No. 10,974,797 may be difficult using traditional hand-held tools. For example, forming opposing channel walls having a precise curve shape with perpendicular sidewalls may be difficult with traditional hand shaping methods. Further, more advanced shaping software and shaping machines commonly used for surfcraft may not be capable of shaping channels having curved perpendicular sidewalls. Shaping a surf craft channel having curved surfaces that, for example, vary simultaneously in two dimensions may be difficult and time consuming, particularly when sidewalls of the channel are perpendicular to a bottom of the channel.

What is needed, therefore, is a blank for forming a surf craft that allows for effective shaping of the surf craft and any features formed on the surf craft.

SUMMARY

The above and other needs are met by a blank for forming a surf craft and a method therefore that allows for forming of a surf craft having complex shapes. In a first aspect, a method of forming a surf craft includes: providing a bottom section including a surface thereon, wherein at least a portion of the bottom surface section defines a bottom portion of a channel formed on a bottom surface of the surf craft; joining a first side section with the bottom section towards a first side of the bottom section, the first side section having a shaped wall portion defining a first side wall of the channel formed on the bottom surface of the surf craft; joining a second side section with the bottom section towards a second side of the bottom section, the second side section having a shaped wall portion defining a second side wall of the channel formed on the bottom surface of the surf craft, the second side wall being opposed to the first side wall; and shaping one or more outer edges of the bottom section, first side section, and second side section into a desired shape of the surf craft.

The method may further include forming a curved portion in the shaped wall portion of the first side section prior to joining the first side section with the bottom section and forming a curved portion in the shaped wall portion of the second side section prior to joining the second side section with the bottom section.

The shaped wall portion of the first side section and the shaped wall portion of the second side section may be perpendicular to the bottom portion of the bottom section. Curved sides may be formed on the bottom section, the curved sides correspond to the curved portion of the first side section and the curved portion of the second side section.

The bottom section may define a center of the surf craft, the first side section may be located adjacent to a first side of the bottom section and defines a first side of the surf craft; and the second side section may be located adjacent to a second side of the bottom section and may define a second side of the surf craft.

The first side section may be located on the surface of the bottom section at a first side of the bottom section, and the second side section may be located on the surface of the bottom section on a second side of the bottom section. The one or more outer edges of the bottom section, first side section, and second side section may be shaped into the desired shape of the surf craft prior to joining the bottom section, first side section, and second side section.

The portion of the bottom surface section that defines the bottom portion of the channel may be formed with a sloped surface prior to joining the bottom section with the first side section and the second side section.

In a second aspect, a surf craft includes: a bottom section including a surface thereon, wherein at least a portion of the bottom surface section defines a bottom portion of a channel formed on a bottom surface of the surf craft; a first side section joined with the bottom section towards a first side of the bottom section, the first side section having a shaped wall portion defining a first side wall of the channel formed on the bottom surface of the surf craft; and a second side section with the bottom section towards a second side of the bottom section, the second side section having a shaped wall portion defining a second side wall of the channel formed on the bottom surface of the surf craft, the second side wall being opposed to the first side wall. The bottom portion of the bottom section, the first side wall of the first side section, and the second side wall of the second section may define a channel formed at least partially along a bottom of the surf craft.

The first side wall of the first side section and the second side wall of the second side section may be curved. The first side wall and the second side wall may be formed in asymptotic curves.

The bottom section may define a center portion of the surf craft; the first side section may be located adjacent to a first side of the bottom section and defines a first side of the surf craft; and the second side section may be located adjacent to a second side of the bottom section and defines a second side of the surf craft.

The bottom section may extend across a width of the surf craft; the first side section may be located on the surface of the bottom section at a first side of the bottom section; and the second side section may be located on the surface of the bottom section on a second side of the bottom section.

The portion of the bottom section that defines the bottom of the channel may be sloped.

In a third aspect, a surf craft includes a bottom section including a surface thereon, wherein at least a portion of the bottom surface section defines a bottom portion of a channel formed on a bottom surface of the surf craft; a first side section joined with the bottom section towards a first side of the bottom section, the first side section having a curved wall portion defining a first side wall of the channel formed on the bottom surface of the surf craft; and a second side section with the bottom section towards a second side of the bottom section, the second side section having a curved wall portion defining a second side wall of the channel formed on the bottom surface of the surf craft, the second side wall being opposed to the first side wall. The bottom portion of the bottom section, the first side wall of the first side section, and the second side wall of the second section define a channel formed at least partially along a bottom of the surf craft.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Figure 1:
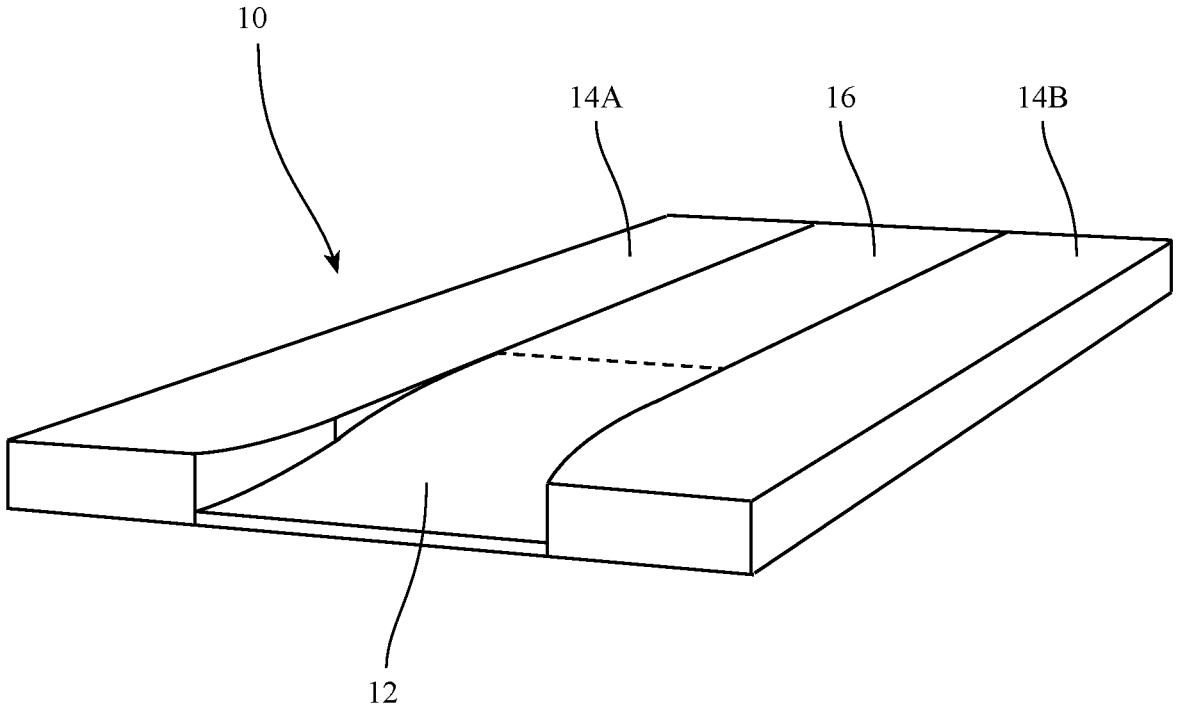
FIG. 1 shows a perspective view of a blank for forming a surf craft according to one embodiment of the present disclosure.

FIG. 1 shows an embodiment of an assembled blank 10 for forming a surf craft. The blank 10 is preferably formed such that a resulting surf craft may be shaped from the blank, such as by sanding or cutting of the blank into a desired shape for the surf craft. The blank 10 is formed of a plurality of sections, such as three separate sections, that may be joined together as shown in FIG. 1. Embodiments of the blank 10 described herein advantageously allow for shaping of a surf craft having complex features or shapes in the surf craft, such as a channel 12.

The channel 12 or other features of the surf craft may be shapes that are formed on surfaces of the surf craft. For example, the channel 12 may be formed according to the disclosure of U.S. Pat. No. 10,974,797, which is incorporated herein by reference in its entirety. Such channel may include a shaped bottom surface and opposing sidewalls that are perpendicular to the bottom surface. Further, the opposing sidewalls may be curved and extend parallel to one another along at least a partial length of the sidewalls. The channel may be formed along an entire length or a partial length of the surf craft. Opposing sidewalls may be curved along an entire length of the channel. The opposing sidewalls may be formed in asymptotic curves.

Figure 2:
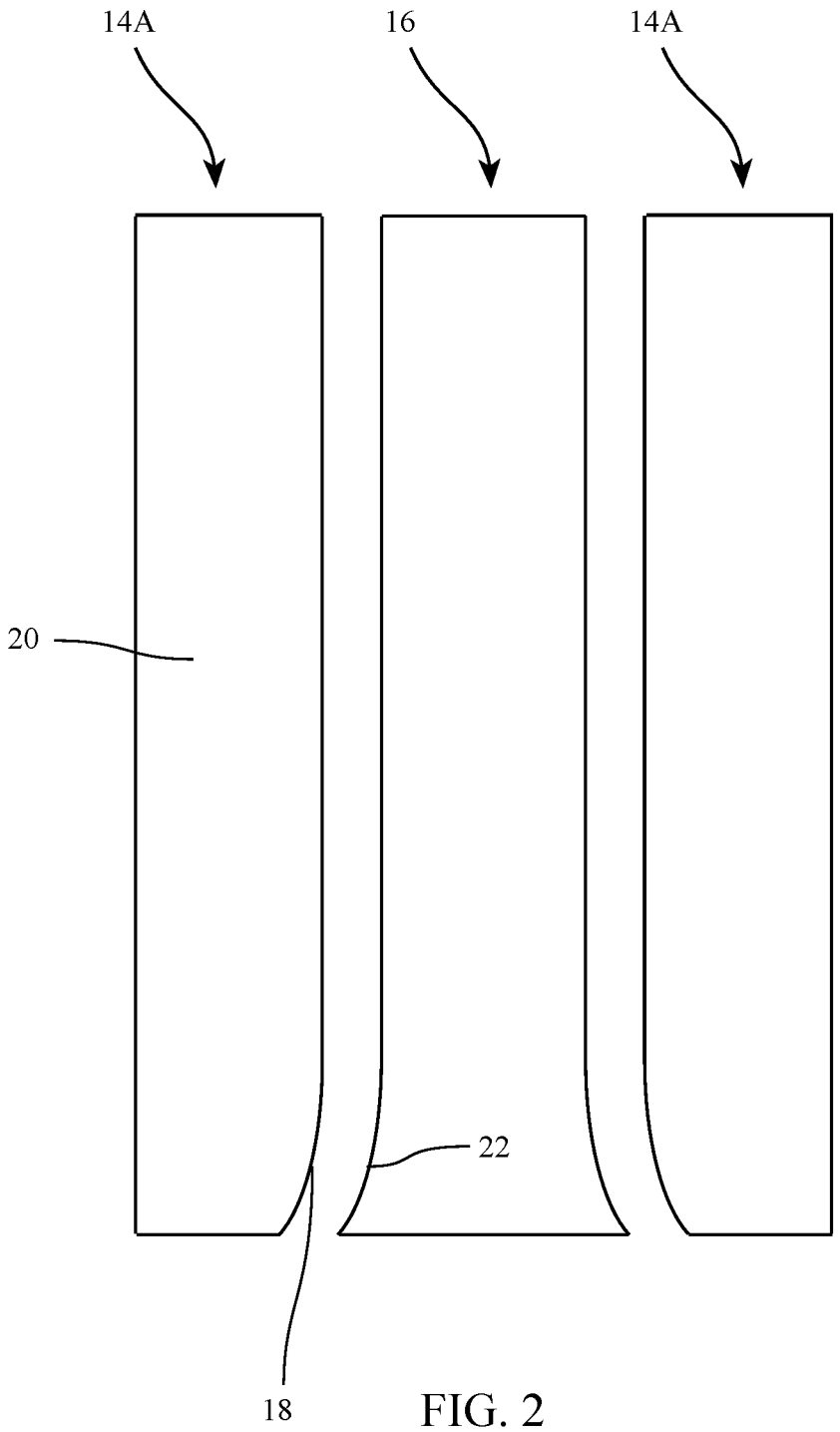
FIG. 2 shows a top exploded view of a blank for forming a surf craft according to one embodiment of the present disclosure.

The blank 10 may be formed of opposing side sections 14A and 14B and a center section 16 extending lengthwise there between. As shown in FIG. 2, each of the opposing side sections 14A and 14B and the center section 16 may be formed in separate pieces or sections that are subsequently joined together to form the blank 10. Prior to joining, each of the opposing side sections 14A and 14B and the center section 16 are formed in desired shapes. The opposing side sections 14A and 14B and the center section 16 are subsequently joined, such as by bonding the sections to one another with an adhesive or otherwise fastening the sections together, to form the blank 10 for further shaping of the blank 10 into a resulting surf craft.

The opposing side sections 14A and 14B and the center section 16 of the blank 10 may be formed of a variety of suitable materials. The opposing side sections 14A and 14B may be formed of a solid shapeable material, such as foam. It is also understood that the opposing side sections 14A and 14B and the center section 16 of the blank 10 may be formed of other suitable materials. In one embodiment, one or more portions of the blank 10 may be formed of inflatable or air-filled members, such as pre-shaped or pre-formed portions that are inflatable. Pre-shaped or pre-formed portions may be formed having one or more flexible or solid walls and may be inflatable to support a shape of the pre-shaped or pre-formed portions.

Figure 3A:
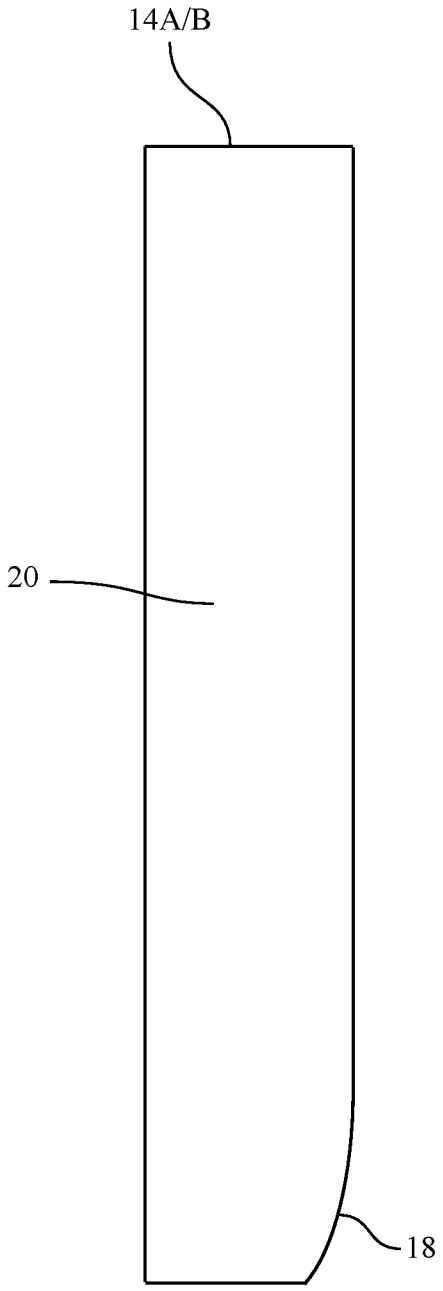
FIG. 3A shows a top view of one of the opposing side sections of a blank for forming a surf craft according to one embodiment of the present disclosure.
Figure 3B:
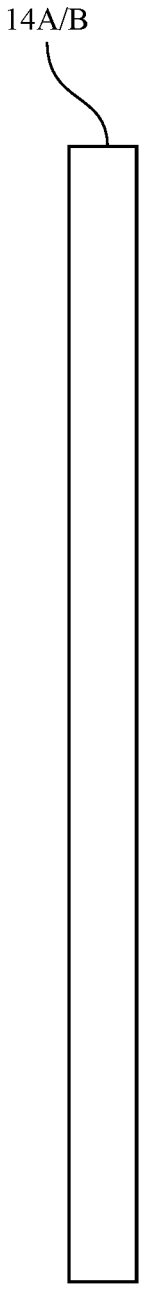
FIG. 3B shows a side view of one of the opposing side sections of a blank for forming a surf craft according to one embodiment of the present disclosure.

Each of the opposing side sections 14A and 14B may be formed having a curved side 18, as shown in FIGS. 2 and 3A-3B. A shape of the curved side 18 may vary depending on a desired resulting channel to be formed in the blank 10. The curved side 18 may be formed such that the curved side 18 is substantially perpendicular to a bottom surface 20 (FIG. 2) of each of the opposing side sections 14A and 14B, with the bottom surface 20 eventually forming a bottom surface section of a surf craft after shaping of the resulting blank 10 including a surface thereon. The center section 16 may also include curved sides 22 having a shape corresponding to the curved side 18 of each of the opposing side sections 14A and 14B.

Referring to FIGS. 3A and 3B, each of the opposing side sections 14A and 14B may have a thickness profile based on a desired shape of the blank 10 and resulting surf craft. For example, when forming the channel 12 (FIG. 1), it may be desirable for each of the opposing side sections 14A and 14B to have a constant thickness along a length of each of the opposing side sections 14A and 14B. A thickness of the resulting blank may be subsequently modified by shaping of the blank into a desired surf craft.

Figure 4A:
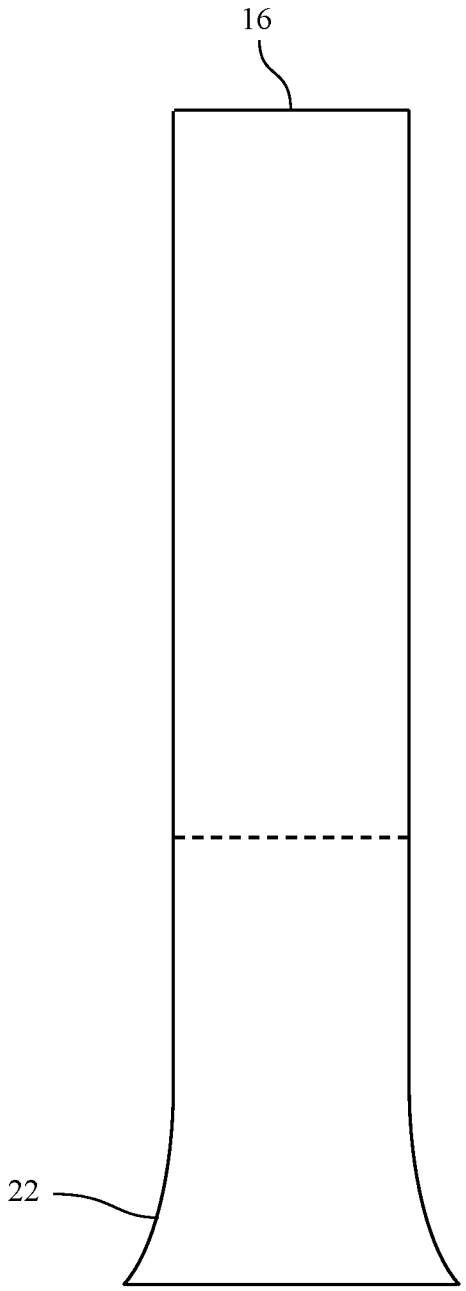
FIG. 4A shows a top view of a center section of a blank for forming a surf craft according to one embodiment of the present disclosure.
Figure 4B:
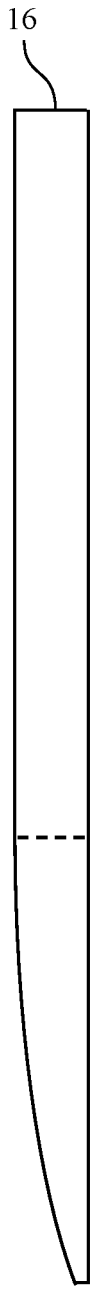
FIG. 4B shows a side view of a center section of a blank for forming a surf craft according to one embodiment of the present disclosure.
Figure 5A:
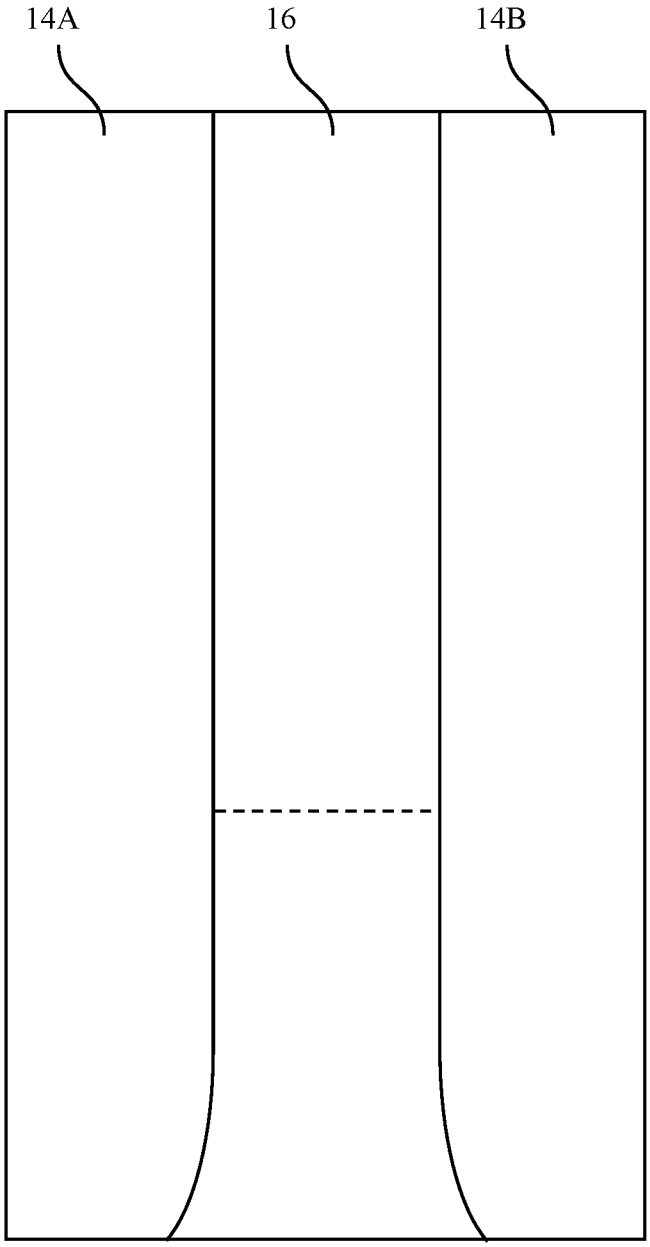
FIG. 5A shows a top view of a blank assembled from the opposing side sections and the center section according to one embodiment of the present disclosure.
Figure 5B:
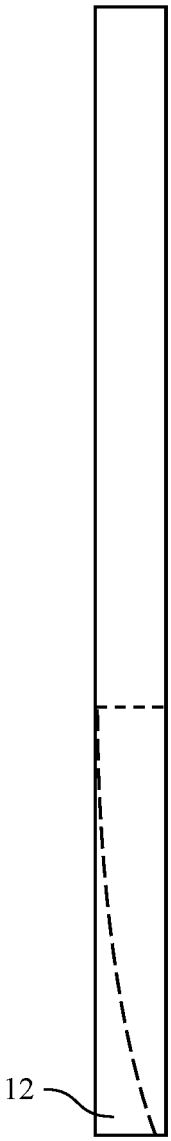
FIG. 5B shows a side view of a blank assembled from the opposing side sections and the center section according to one embodiment of the present disclosure.
Figure 6A:
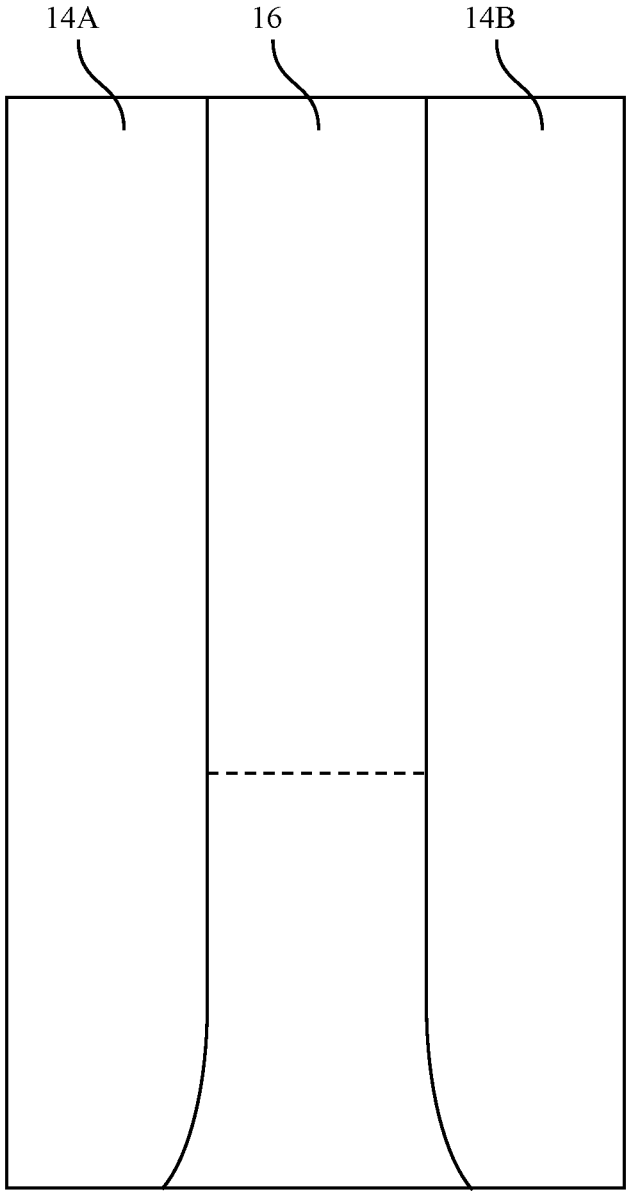
FIG. 6A shows a top view of a blank assembled from the opposing side sections and the center section having a channel extending along a full length of the blank according to one embodiment of the present disclosure.
Figure 6B:
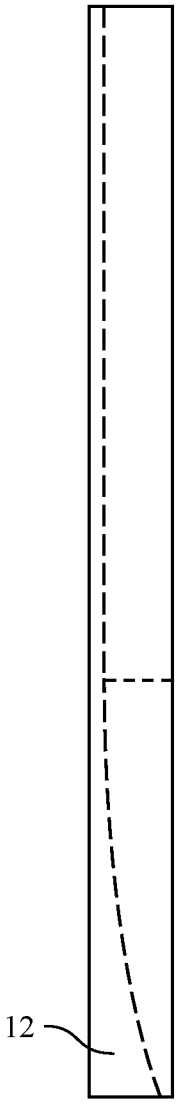
FIG. 6B shows a side view of a blank assembled from the opposing side sections and the center section having a channel extending along a full length of the blank according to one embodiment of the present disclosure.
Figure 7A:
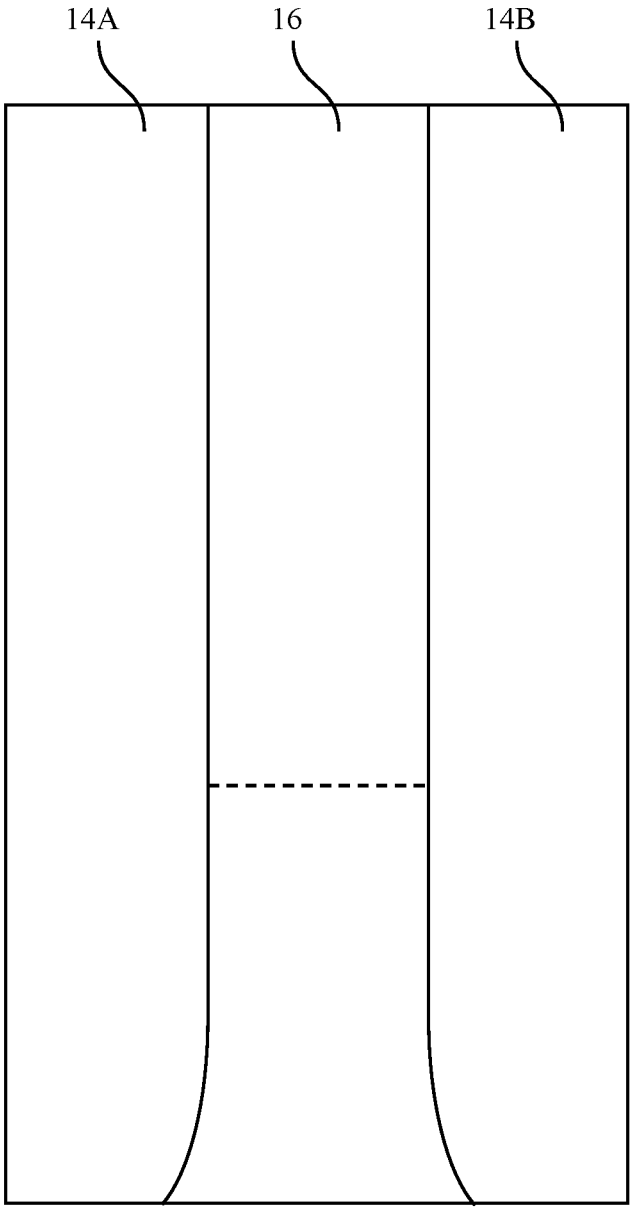
FIG. 7A shows a top view of a blank having a channel along a substantial length of the blank with curved bottom ends according to one embodiment of the present disclosure.
Figure 7B:
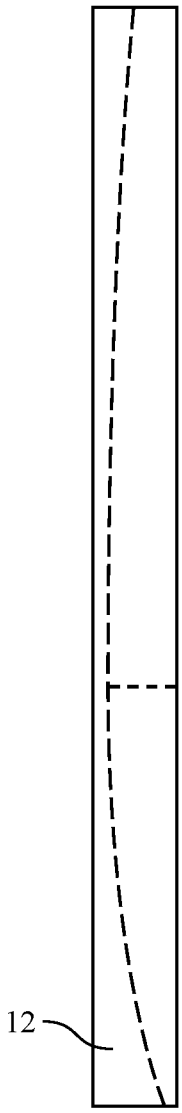
FIG. 7B shows a side view of a blank having a channel along a substantial length of the blank with curved bottom ends according to one embodiment of the present disclosure.

Referring to FIGS. 4A and 4B, the center section 16 may have a thickness profile based on a desired shape of the blank 10 and resulting surf craft. As shown in FIG. 4B, a thickness of the center section 16 may vary along a length of the center section 16. For example, when forming the channel of FIG. 1, it may be desirable for the center section 16 to have a sloped or tapered thickness along at least a portion of the center section 16. The center section 16 has a thickness that is substantially formed prior to joining the center section 16 with the opposing side sections 14A and 14B. Referring to FIGS. 5A-5B and 6A-6B, a thickness of the center section 16 may vary in contrast to the opposing side sections 14A and 14B. For example, a thickness of the center section 16 may be the same as a thickness of the opposing side sections 14A and 14B along at least a partial length of the center section 16, as shown in FIG. 5B. Alternatively, a thickness of the center section 16 may differ along an entire length of the center section 16 relative to the opposing side sections 14A and 14B. For example, as shown in FIG. 6B, a thickness of the center section 16 along its length is less than a thickness of the opposing side sections 14A and 14B. As shown in FIG. 7A and FIG. 7B, a shape of the center section 16 may further be such that the center section 16 is sloped at both ends of the center section 16.

Figure 8:
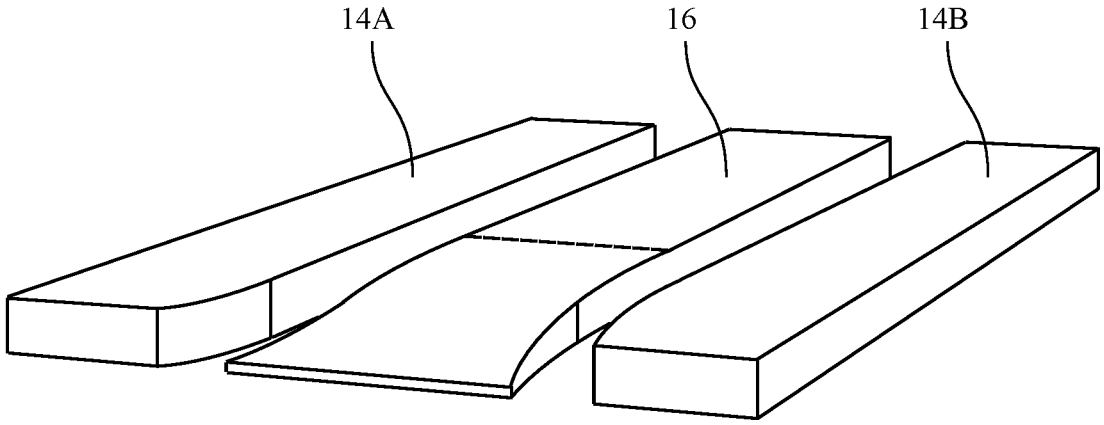
FIG. 8 shows an exploded perspective view of a blank for forming a surf craft according to one embodiment of the present disclosure.

Referring to FIG. 8, to form the blank 10, each of the opposing side sections 14A and 14B and the center section 16 is individually formed based on a desired shape of the blank 10 and a surf craft to be formed from the blank. Shapes of the opposing side sections 14A and 14B and the center section 16 may be selected prior to joining of the opposing side sections 14A and 14B with the center section 16. The opposing side sections 14A and 14B and the center section 16 may be substantially shaped prior to joining to form the blank 10, thereby allowing shapes of walls of the channel and other surfaces of the blank 10 to be readily created.

To form the blank 10, the opposing side sections 14A and 14B and the center section 16 are joined along one or more sides of the opposing side sections 14A and 14B and the center section 16. As shown in FIG. 1, when the opposing side sections 14A and 14B and the center section 16 are joined, each of the opposing side sections 14A and 14B is adjacent to the center section 16. The resulting blank 10 includes the channel 12 having a desired shape. The channel 12 is formed from the side 18 of each of the opposing side sections 14A and 14B and a bottom surface of the center section 16. By forming each of the opposing side sections 14A and 14B and the center section 16 prior to joining to form the blank 10, walls of the channel may be formed to have shapes that would otherwise be difficult if attempting to form the channel by cutting the channel into an existing blank 10.

When the opposing side sections 14A and 14B are joined with the center section 16 to form the blank 10, the resulting blank 10 may be formed having various shapes for further shaping to form a desired surf craft. For example, as shown in FIGS. 1 and 5A, the blanks 10 may be an unshaped slab or rectangular blank. Alternatively, and as shown in FIG. 9, the surf craft planshape cut out from the blank 10 may have rounded outer edges for further shaping into a desired surf craft.

Figure 9:
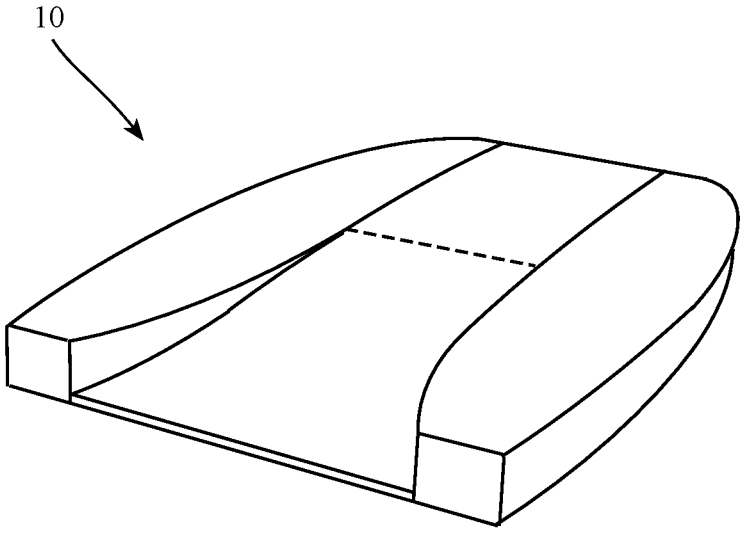
FIG. 9 shows a perspective view of a blank having shaped outer edges according to one embodiment of the present disclosure.
Figure 10:
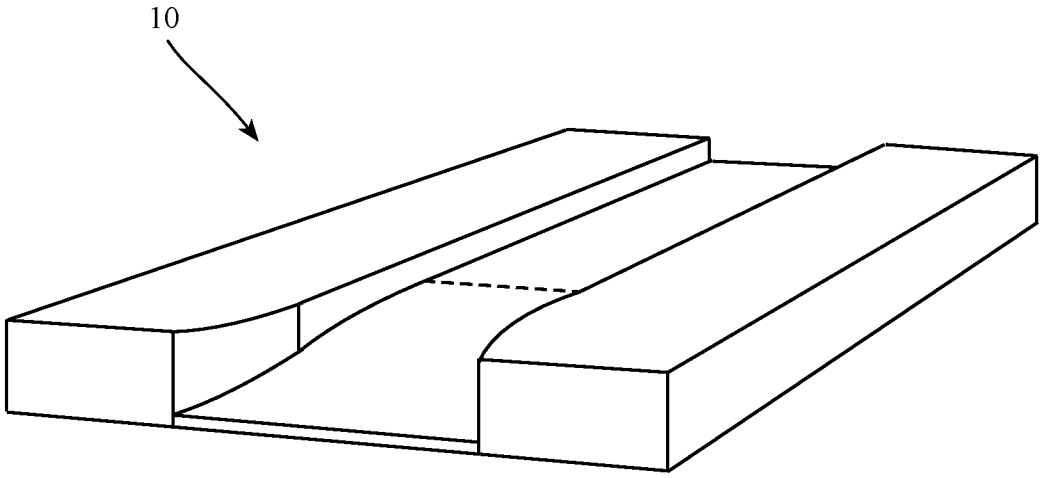
FIG. 10 shows a perspective view of a blank having a channel along substantially a full length of the blank having a variable depth according to one embodiment of the present disclosure.
Figure 11:
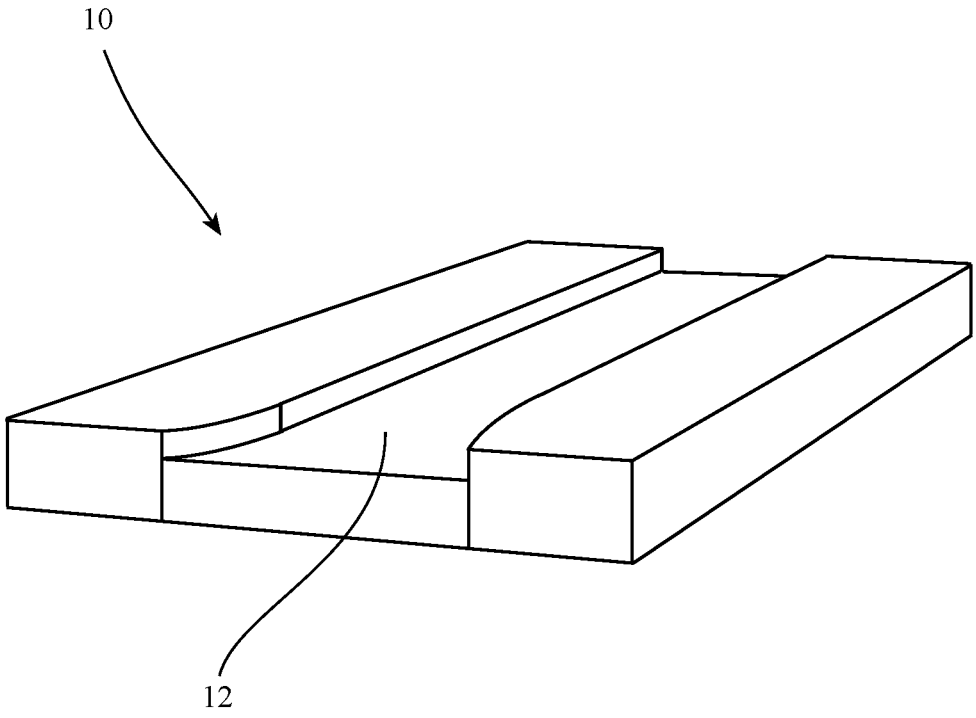
FIG. 11 shows a perspective view of a blank having a channel along substantially a full length of the blank having a substantially constant depth according to one embodiment of the present disclosure.
Figure 12:
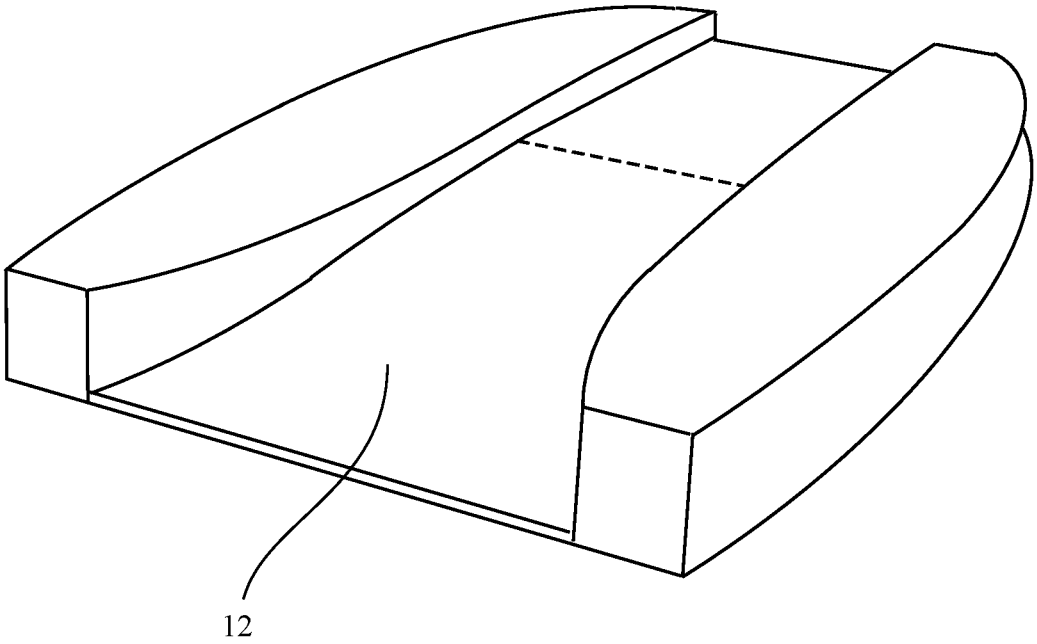
FIG. 12 shows a perspective view of a blank having shaped outer edges and a channel along a full length of the blank according to one embodiment of the present disclosure.
Figure 18:
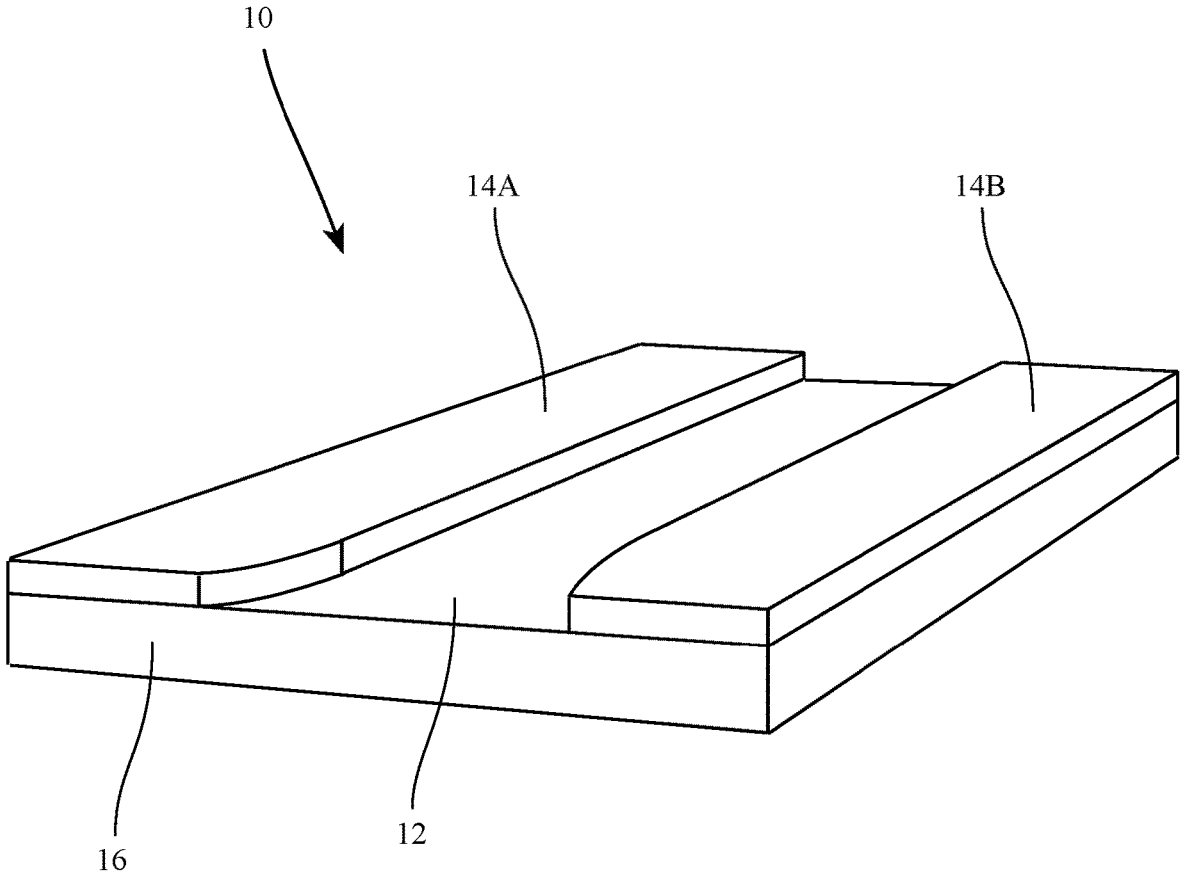
FIG. 18 shows a perspective view of a blank for forming a surf craft according to one embodiment of the present disclosure.
Figure 19:
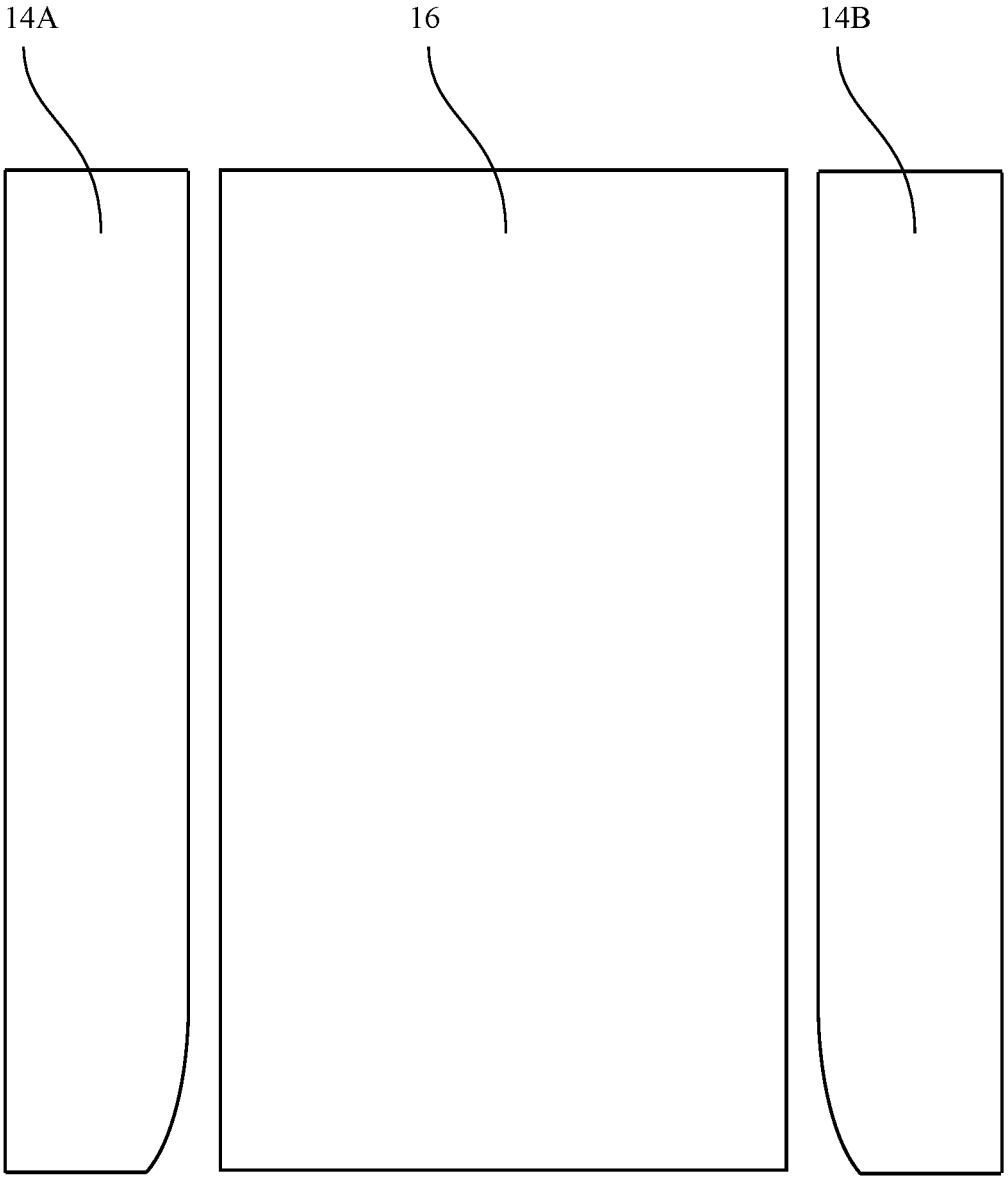
FIG. 19 shows an exploded plan view of a blank for forming a surf craft according to one embodiment of the present disclosure.

As described herein, the channel 12 may be formed along a partial length of the blank 10, as shown in FIGS. 1 and 9. As shown in FIG. 10 and FIG. 11, and FIG. 18; the channel 12 may alternatively be formed along an entire length of the blank 10. The channel 12 may have a depth that varies along a length of the channel 12, such as the channel 12 having a greater depth at one end of the blank 10, as shown in FIG. 10. FIG. 12 shows a resulting surf craft having the channel 12 with a varying depth along a length of the channel 12.

Alternatively, the channel 12 may have a substantially constant depth along a length of the channel 12, as shown in FIG. 11 and FIG. 18.

Figure 13:
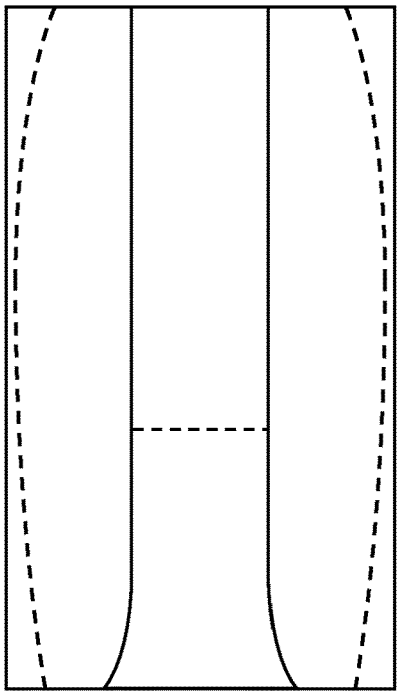
FIG. 13 and FIG. 14 show top views of a blank for forming a surf craft, with a shape of a resulting surf craft delineated in broken lines according to one embodiment of the present disclosure.
Figure 14:
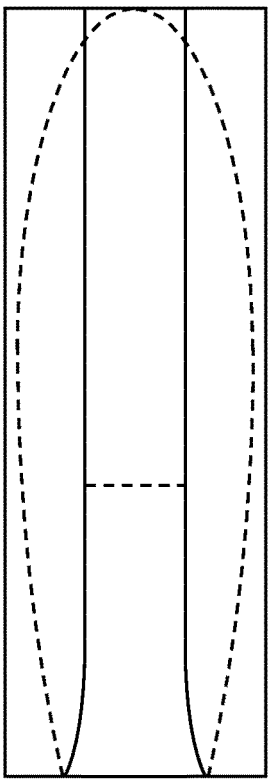
Figure 15A:
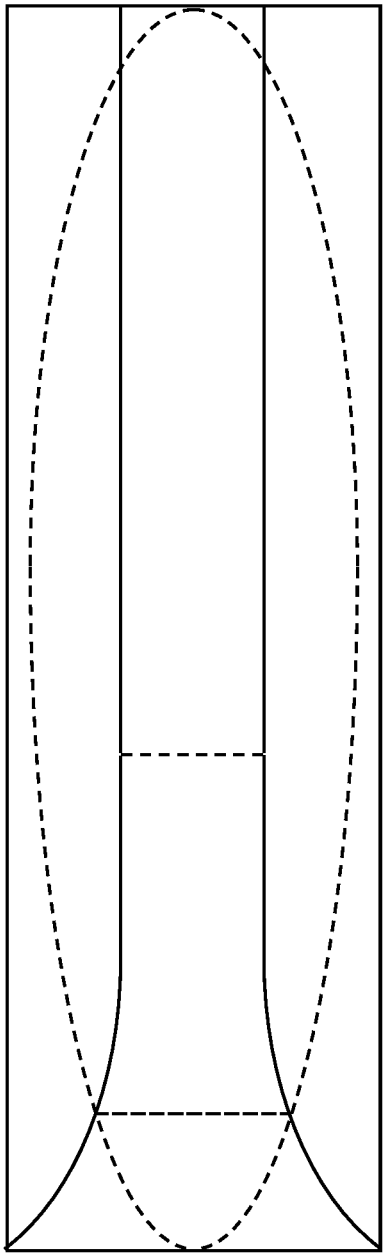
FIG. 15A shows a top view of a blank and a surf craft outlined thereon according to one embodiment of the present disclosure.
Figure 15B:
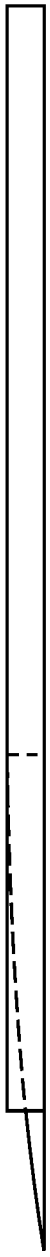
FIG. 15B shows a side view of the blank of FIG. 15A according to one embodiment of the present disclosure.
Figure 16A:
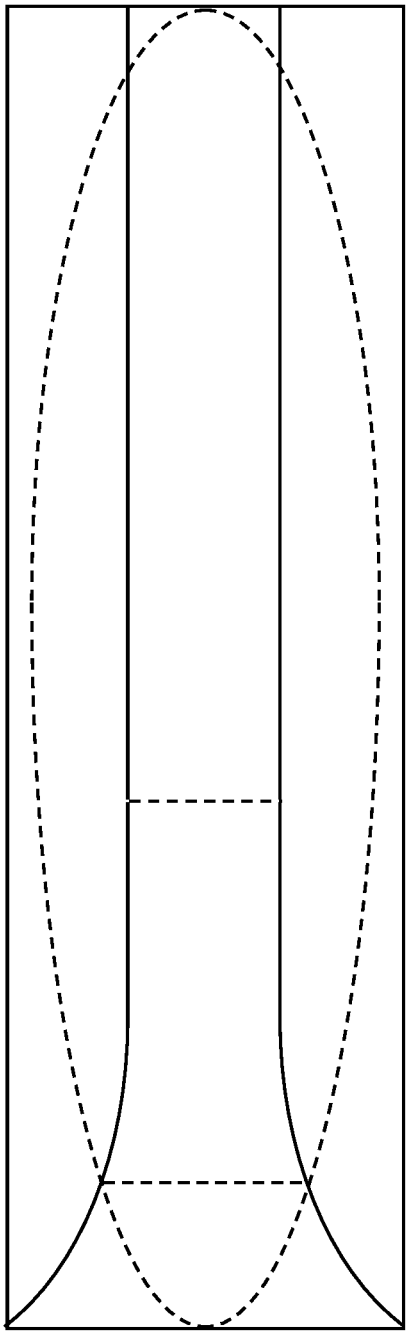
FIG. 16A shows a top view of a blank and a surf craft with a full-length channel outlined thereon according to one embodiment of the present disclosure.
Figure 16B:
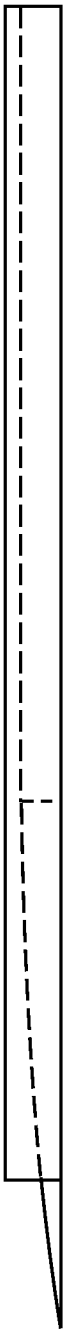
FIG. 16B shows a side view of the blank of FIG. 16A with a full-length channel according to one embodiment of the present disclosure.

Referring now to FIG. 13, FIG. 14, and FIG. 15, the blank 10 may subsequently be shaped into a desired surf craft after joining of the opposing side sections 14A and 14B with the center section 16. A shape of the surf craft resulting from the blank 10 may vary, such as to form the blank 10 into a surf craft having a desired shape and size. For example, the blank 10 may be formed into a shorter surf craft, such as a bodyboard, or alternatively may be formed into a longer surf craft such as a surfboard. FIG. 15A and FIG. 15B illustrate channel exits before a tail end of a surf craft. FIG. 16A and FIG. 16B illustrate a full-length channel. It is also understood that a two-channel surf craft could be formed, such as from a five-piece blank. The surf craft may include two channel bottom sections and three sidewall sections.

Figure 17A:
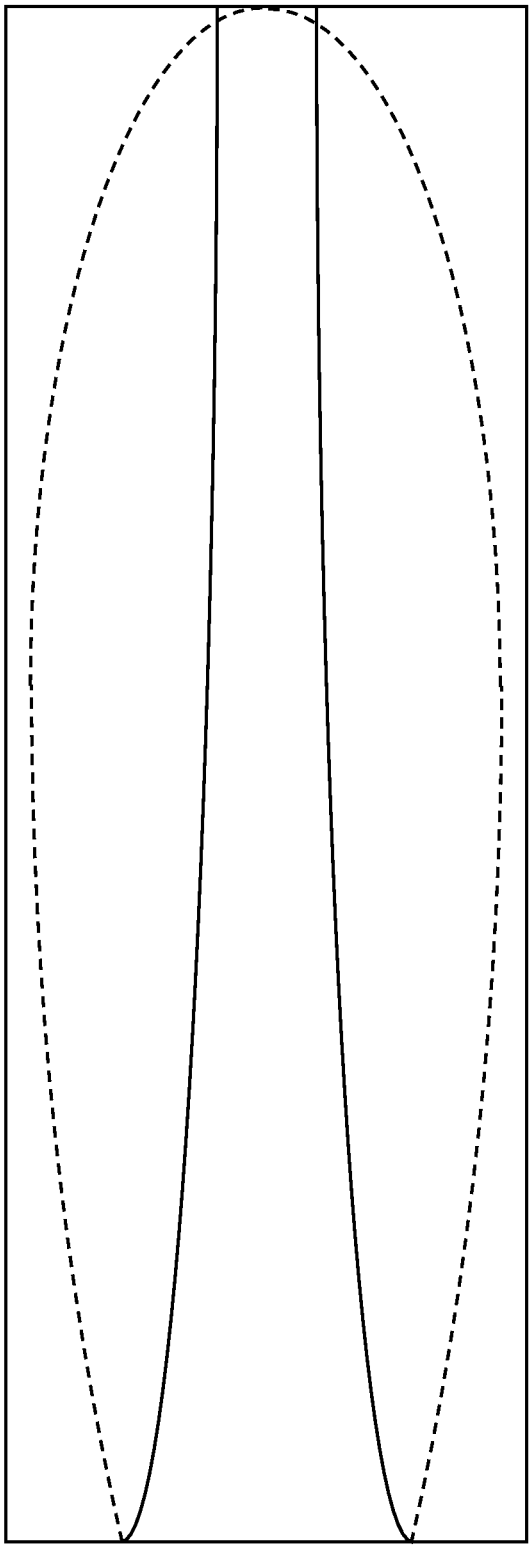
FIG. 17A and FIG. 17B show a surf craft planshape on a blank having a full-length channel with both channel bottom and sidewalls curved along an entire length of the surfboard according to one embodiment of the present disclosure.
Figure 17B:
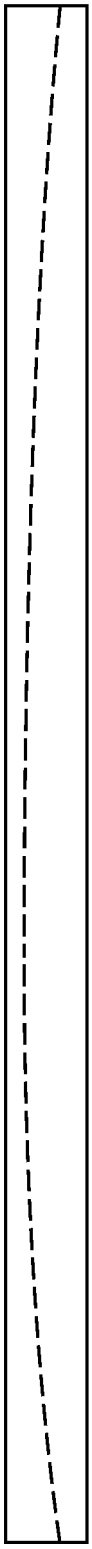

Referring to FIG. 17A and FIG. 17B, a surfboard planshape is illustrated. The surfboard planshape may be formed, for example, on a three-piece blank with a full-length channel located along the entire length of the surfboard. Both a channel bottom and sidewalls may be curved along an entire length of the channel.

Referring now to FIG. 18, FIG. 19, FIG. 20A, and FIG. 20B, the blank 10 may be formed in other suitable arrangements that allow for the channel 12 to be formed on the blank 10. For example, the center section 16 may be formed such that the center section 16 extends substantially across a full width of the blank 10. The center section 16 may extend to sides of the blank 10 such that outer edges of the center section 16 form at least a portion of sides of a resulting surf craft formed from the blank 10.

The opposing side sections 14A and 14B may be located on the center section 16 as shown in FIG. 18. The opposing side sections 14A and 14B may be bonded to a surface of the center section 16 and may be located such that inner edges of the opposing side sections 14A and 14B define side walls of the channel 12. Outer edges of the opposing side sections 14A and 14B may be substantially aligned with outer edges of the center section 16. Outer edges of the center section 16 and the opposing side sections 14A and 14B may be shaped to create a desired shape of a surf craft formed from the blank 10.

Figure 20A:
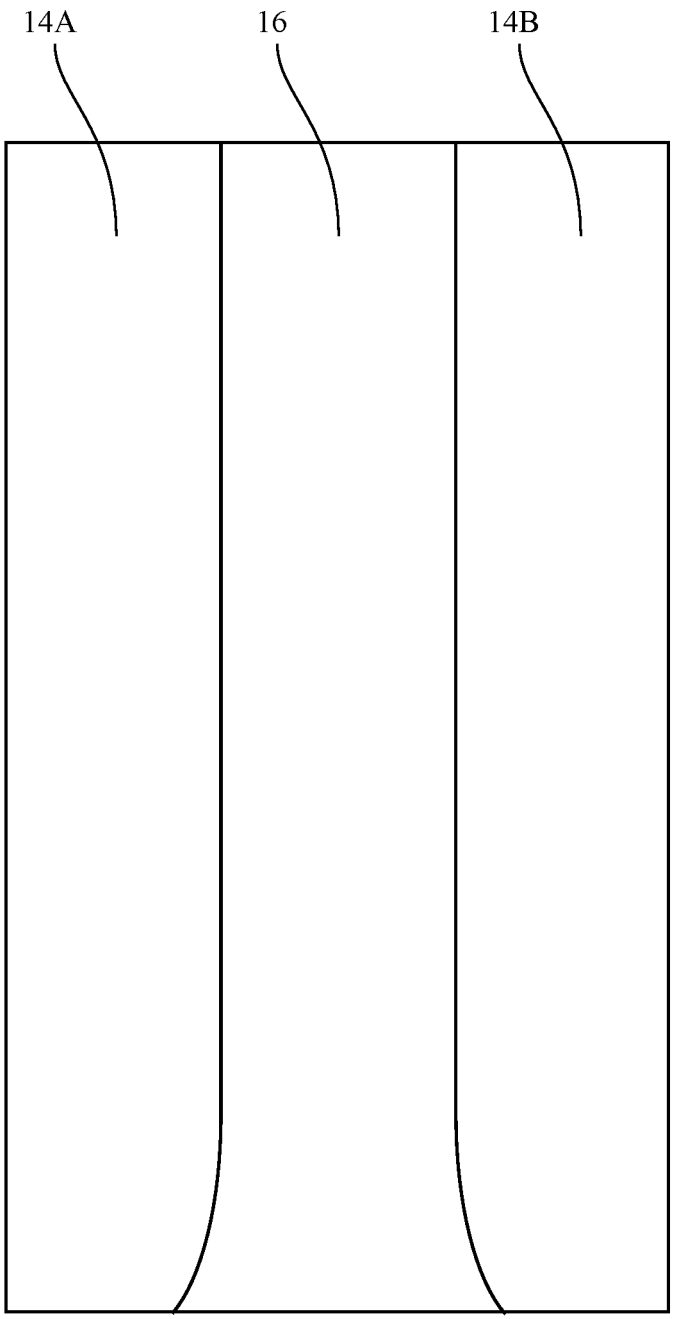
FIG. 20A shows a top view of a blank for forming a surf craft according to one embodiment of the present disclosure.
Figure 20B:
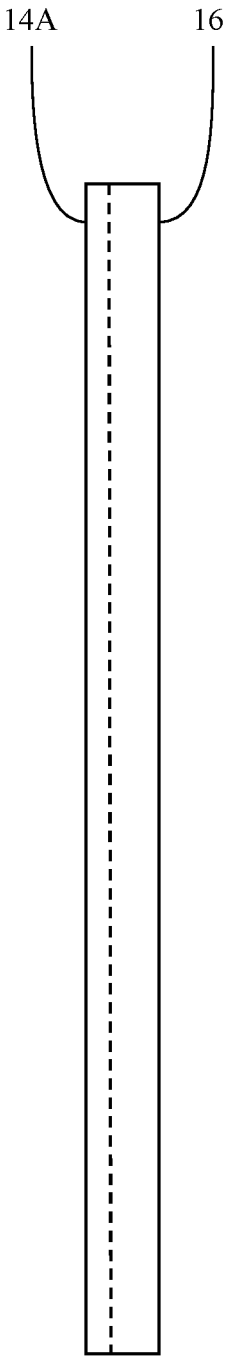
FIG. 20B shows a side view of a blank for forming a surf craft according to one embodiment of the present disclosure.

As shown in FIGS. 18, FIG. 20A, and FIG. 20B, a thickness of the center section 16 may be greater than a thickness of the opposing side sections 14A and 14B. A thickness of the opposing side sections 14A and 14B may correspond to a desired depth of the channel formed on the blank 10. A thickness of the center section 16 and the opposing side sections 14A and 14B may vary. For example, a thickness of the center section 16 and the opposing side sections 14A and 14B may vary along lengths of the sections, such as based on a desired shape of the channel formed on the blank 10.

By forming each of the opposing side sections 14A and 14B and the center section 16 prior to joining to form the blank 10, any surface features such as those that may be relatively complex to be formed by existing shaping methods are easily formed in the blank 10. This allows the resulting surf craft to be formed having a desired shape, thereby allowing more accurate forming of shapes such as a channel in the surf craft.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A method of forming a surf craft, the method comprising:

providing a bottom section including a surface thereon, wherein at least a portion of the surface of the bottom section defines a portion of a channel formed on a bottom surface of the surf craft;

forming a curved portion on a shaped wall portion of a first side section;

forming a curved portion on a shaped wall portion of a second side section;

forming a first curved side on the bottom section corresponding to the curved portion of the first side section;

forming a second curved side on the bottom section corresponding to the curved portion of the second side section;

joining the first side section with the bottom section at the first curved side of the bottom section such that the curved portion of the first side section defines a first side wall of the channel formed on the bottom surface of the surf craft;

joining the second side section with the bottom section at the second curved side of the bottom section such that the curved portion of the second side section defines a second side wall of the channel formed on the bottom of the surf craft; and shaping one or more outer edges of the bottom section, first side section, and second side section into a desired shape of the surf craft.

2. The method of claim 1, wherein the shaped wall portion of the first side section and the shaped wall portion of the second side section are perpendicular to the surface on the bottom section.

3. The method of claim 1, wherein:

the bottom section defines a center of the surf craft;

the first side section defines a first side of the surf craft; and the second side section defines a second side of the surf craft.

4. The method of claim 1, wherein the one or more outer edges of the bottom section, the first side section, and the second side section are shaped into the desired shape of the surf craft prior to joining the bottom section, the first side section, and the second side section.

5. The method of claim 1, wherein the portion of the bottom surface section of the surf craft that defines the portion of the channel is formed with a sloped surface prior to joining the bottom section with the first side section and the second side section.

6. The method of claim 1, wherein the channel formed on the bottom surface of the surf craft extends along a length of the surf craft.

7. A surf craft comprising:

a bottom section including a surface thereon, wherein at least a portion of the surface of the bottom section has reduced thickness in an aft direction to define a sloped portion of a channel formed on a bottom surface of the surf craft;

a first side section joined with the bottom section towards a first side of the bottom section, the first side section having a shaped wall portion defining a first side wall of the channel formed on the bottom surface of the surf craft, wherein the shaped wall portion defining the first side wall of the channel is perpendicular to the portion of the surface of the bottom section defining the sloped portion of the channel; and a second side section joined with the bottom section towards a second side of the bottom section, the second side section having a shaped wall portion defining a second side wall of the channel formed on the bottom surface of the surf craft, the second side wall being opposed to the first side wall wherein the shaped wall portion defining the second side wall of the channel is perpendicular to the portion of the surface of the bottom section defining the sloped portion of the channel;

wherein the portion of the surface of the bottom section defining the sloped portion of the channel is sloped relative to an upper surface of the bottom section.

8. The surf craft of claim 7, wherein the first side wall of the first side section and the second side wall of the second side section are curved.

9. The surf craft of claim 8, wherein the first side wall and the second side wall are formed in asymptotic curves.

10. The surf craft of claim 7, wherein:

the bottom section defines a center portion of the surf craft;

the first side section is located adjacent to the first side of the bottom section and defines a first side of the surf craft; and the second side section is located adjacent to the second side of the bottom section and defines a second side of the surf craft.

11. The surf craft of claim 7, wherein:

the bottom section extends across a width of the surf craft;

the first side section is located on the surface of the bottom section at the first side of the bottom section; and the second side section is located on the surface of the bottom section at the second side of the bottom section.

12. A surf craft comprising:

a bottom section, wherein at least a portion of the bottom section has reduced thickness in an aft direction to define a sloped surface of a channel formed on a bottom surface of the surf craft;

a first side section joined with the bottom section towards a first side of the bottom section, the first side section having a curved wall portion defining a first side wall of the channel formed on the bottom of the surf craft, wherein the curved wall portion defining the first side wall of the channel is perpendicular to the portion of the surface of the bottom section defining the sloped portion of the channel; and a second side section joined with the bottom section towards a second side of the bottom section, the second side section having a curved wall portion defining a second side wall of the channel formed on the bottom of the surf craft, the second side wall being opposed to the first side wall, wherein the curved wall portion defining the second side wall of the channel is perpendicular to the portion of the surface of the bottom section defining the sloped portion of the channel;

wherein the portion of the surface of the bottom section defining the sloped portion of the channel is sloped relative to a bottom portion of the first side section and a bottom portion of the second side section.

* * * * *